US009140100B2

(12) United States Patent
Daccord et al.

(10) Patent No.: US 9,140,100 B2
(45) Date of Patent: Sep. 22, 2015

(54) MOVABLE WELL BORE CLEANING DEVICE

(75) Inventors: Gérard Daccord, Vauhallan (FR); Diego Moser, Aberdeenshire (GB); Mathew Samuel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1047 days.

(21) Appl. No.: 13/057,283

(22) PCT Filed: Jul. 17, 2009

(86) PCT No.: PCT/EP2009/005547

§ 371 (c)(1),
(2), (4) Date: Jul. 19, 2011

(87) PCT Pub. No.: WO2010/017899

PCT Pub. Date: Feb. 18, 2010

(65) Prior Publication Data

US 2011/0266000 A1 Nov. 3, 2011

(30) Foreign Application Priority Data

Aug. 11, 2008 (EP) ..... 08290767

(51) Int. Cl.
*E21B 37/02* (2006.01)
*E21B 37/04* (2006.01)
*B08B 1/04* (2006.01)

(52) U.S. Cl.
CPC . *E21B 37/02* (2013.01); *B08B 1/04* (2013.01); *E21B 37/04* (2013.01)

(58) Field of Classification Search
CPC ..... E21B 37/02; E21B 37/04; E21B 37/045; E21B 12/06
USPC ..... 166/173, 105.2, 311, 223, 175, 170, 70
See application file for complete search history.

(56) References Cited

U.S. PATENT DOCUMENTS

| | | | | | |
|---|---|---|---|---|---|
| 85,622 | A | * | 1/1869 | Taylor | 166/175 |
| 1,600,578 | A | * | 9/1926 | Crickmer | 166/173 |
| 1,758,995 | A | * | 5/1930 | Armstrong et al. | 166/175 |
| 2,215,514 | A | * | 9/1940 | MacGregor | 166/170 |
| 2,220,237 | A | * | 11/1940 | Hall | 166/172 |

(Continued)

FOREIGN PATENT DOCUMENTS

| | | |
|---|---|---|
| EP | 0523236 | 1/1993 |
| SU | 1594265 | 9/1990 |
| SU | 1686131 | 10/1991 |

OTHER PUBLICATIONS

International Search Report for the equivalent PCT patent application No. PCT/EP2009/005547 issued on Sep. 23, 2011.

*Primary Examiner* — Jennifer H Gay
*Assistant Examiner* — David Carroll
(74) *Attorney, Agent, or Firm* — Michael Dae; Rachel Greene; Tim Curington

(57) ABSTRACT

A wellbore cleaning device comprises a tubular section, a helical scratcher mounted thereon. The helical scratcher contains flexible wires characterized in that the helical scratcher is able to rotate axially to the tubular section when a fluid flows axially to the tubular section. A method for using the device comprises placing the device into the wellbore; allowing the fluid flowing axially to the wellbore wall to rotate the scratcher; removing a deposit at wellbore wall; and leaving a cleaned wellbore wall.

16 Claims, 7 Drawing Sheets

(56) References Cited

U.S. PATENT DOCUMENTS

| | | | | | |
|---|---|---|---|---|---|
| 2,224,412 | A | * | 12/1940 | Smith | 166/255.1 |
| 2,287,319 | A | * | 6/1942 | Miller | 166/170 |
| 2,509,492 | A | * | 5/1950 | Gould | 166/170 |
| 2,867,280 | A | | 1/1959 | De Jarnett | |
| 2,969,115 | A | * | 1/1961 | Tripplehorn | 166/176 |
| 3,087,550 | A | * | 4/1963 | Tyrrell, Jr. | 166/173 |
| 3,141,505 | A | * | 7/1964 | Tripplehorn | 166/311 |
| 3,390,725 | A | * | 7/1968 | Alexander, Jr. | 166/172 |
| 4,612,986 | A | * | 9/1986 | Fosdick et al. | 166/171 |
| 4,747,452 | A | * | 5/1988 | Clark | 166/311 |
| 4,750,558 | A | | 6/1988 | Alexander, Jr. | |
| 6,523,612 | B2 | * | 2/2003 | Reynolds | 166/312 |
| 6,832,655 | B2 | * | 12/2004 | Ravensbergen et al. | 166/311 |
| 7,121,336 | B2 | * | 10/2006 | Hatley | 166/170 |
| 7,210,529 | B2 | * | 5/2007 | Ruttley | 166/311 |
| 7,383,881 | B2 | * | 6/2008 | Telfer | 166/212 |
| 7,753,128 | B2 | * | 7/2010 | Moen | 166/370 |
| 2004/0089323 | A1 | * | 5/2004 | Hatley | 134/8 |
| 2006/0185853 | A1 | * | 8/2006 | Bender | 166/372 |
| 2007/0261855 | A1 | * | 11/2007 | Brunet et al. | 166/312 |
| 2012/0211229 | A1 | * | 8/2012 | Fielder et al. | 166/311 |
| 2013/0192818 | A1 | * | 8/2013 | Winn et al. | 166/173 |

* cited by examiner

MOVABLE WELL BORE CLEANING DEVICE

FIELD OF THE INVENTION

The present invention broadly relates to oilfield applications. This invention relates to a movable well bore cleaning device for attachment to a well casing or the like, and more particularly to a movable well bore cleaning device adapted for cleaning the well bore wall before and during cement placement in a subterranean reservoir, such as for instance oil and/or gas reservoir or a water reservoir.

DESCRIPTION OF THE PRIOR ART

At the completion of every oil and gas drilling operation, whether the operation results in production or a dry hole, it is necessary that some cementing be done in the bore hole. In the case of production, the casing must be cemented in the hole for support thereof and prevention of the flow of fluids between formations. In the case of a dry hole, cement plugs must be set at various depths to seal various formations.

When cementing casing, the casing is run into and centered in the hole and then cement is pumped down through the casing to displace the drilling mud from the annulus. When setting a plug, a pipe of relatively small diameter is run into the hole to the depth of the bottom of the plug and cement is pumped through the pipe to displace the mud above the end of the pipe until a plug of sufficient length has been formed at which time the pipe is withdrawn from the hole and the cement is allowed to harden.

In all cases, it is necessary that the walls of the bore hole be cleaned of mud cake and the like so that the cement will bond properly with the formation. Failure to remove unreactive solids between the cement sheath and the formation will leave a potential axial flow path for formation fluids, hence compromising hydraulic isolation.

Mechanical well bore wall cleaning is accomplished by means of devices known as scratchers. Non-mechanical means of cleaning the well—based for instance on the use of wash fluids flowing in turbulent flow—are being used, but they are felt as being less efficient. The turbulent action of wash fluids can be enhanced by placing passive obstacles in the flow conduit that disturb laminar flow.

There are two basic types of scratchers: reciprocating and rotating. Reciprocating scratchers are designed to operate when the casing or pipe to which they are attached is moved axially within the bore hole and they usually include a single collar having a plurality of wire bristles or flat loops of wire extending radially to contact the well bore wall. Another type of reciprocating scratcher includes a pair of collars having a plurality of spiraling wires connecting the collars and a plurality of fingers extending radially outwardly and upwardly from the upper collar, which help cleaning the well bore wall when the casing or pipe is reciprocated.

Rotating type scratchers are designed to operate when the casing or pipe to which they are attached is rotated and include an axially extending strip having thereon a plurality of radially outwardly extending loops or bristles or a combination of loops and bristles. There is an additional rotating scratcher which includes a helical strip having thereon a plurality of radially outwardly extending bristles.

Reciprocating scratchers clean only when reciprocated; rotating scratchers, with the exception of the helical strip type which cleans to a limited extent while reciprocated, clean only when rotated.

In summary, there are a number of existing scratchers that work during casing or pipe reciprocation and/or rotation.

Some of them are disclosed in patents U.S. Pat. Nos. 4,750,558; and 3,390,725. However, all existing scratchers require casing movement to work. In other words, if casing or pipe movement is not feasible, which might be a common case due to different reasons, these scratchers are not useful. None of these solutions work when the tubular remain static.

There are other devices used for different purposes (casing or pipe centralization), know as centralizers. Some of them (in instance: SpiraGlider) consist of a steel centralizer and two asymmetrically-beveled stop collars. The shape of both centralizer and collars is designed to minimize running resistance. The unique stop collar performs both as a positioning device and provides protection to the leading edge of the centralizer. It is designed specifically for highly inclined or horizontal wells and is ideal for use with liner hangers. This configuration allows the centralizer to rotate and also allows a certain degree of axial movement. These movements have the objective of making easier running the casing or pipe. However, they are not designed to work as scratchers, neither to rotate and/or move axially using the fluids flow to induce such movements.

SUMMARY OF THE INVENTION

It is therefore an object of the present invention to provide a movable well bore cleaning device (flow-induced scratcher) that will clean independently of casing movement. It is a further object of the present invention to use the fluids annular flow as the driving force to rotate or move axially mechanical scratchers.

In a first aspect, a device for cleaning a wellbore is disclosed, said device comprises a tubular section, a helical scratcher mounted thereof wherein said helical scratcher contains flexible wires characterized in that the helical scratcher is able to rotate axially to tubular section when a fluid flows axially to tubular section.

Preferably, the device comprises at least two helical scratchers mounted on the tubular section, wherein the two helical scratchers are connected through a cleaning wire and further comprising a restoring aid connected on one side to tubular section and on the other side on one of the helical scratchers. Alternatively, the device can further comprise, on the helical scratcher, a cone like structure to create a jet with the fluid.

In a second aspect, a method to clean a wellbore wall of a well is disclosed, said method comprises the steps of: incorporating a device as previously described into the wellbore; moving the device in the well and allowing the fluid flowing axially to the wellbore wall to rotate the scratcher; removing deposit at wellbore wall; leaving a cleaned wellbore wall.

Preferably, the method further comprises the step of selecting a zone of interest and using one scratcher above the zone of interest and a second scratcher below the zone of interest.

BRIEF DESCRIPTION OF THE DRAWINGS

Further embodiments of the present invention can be understood with the appended drawings.

DETAILED DESCRIPTION

Figure 1:
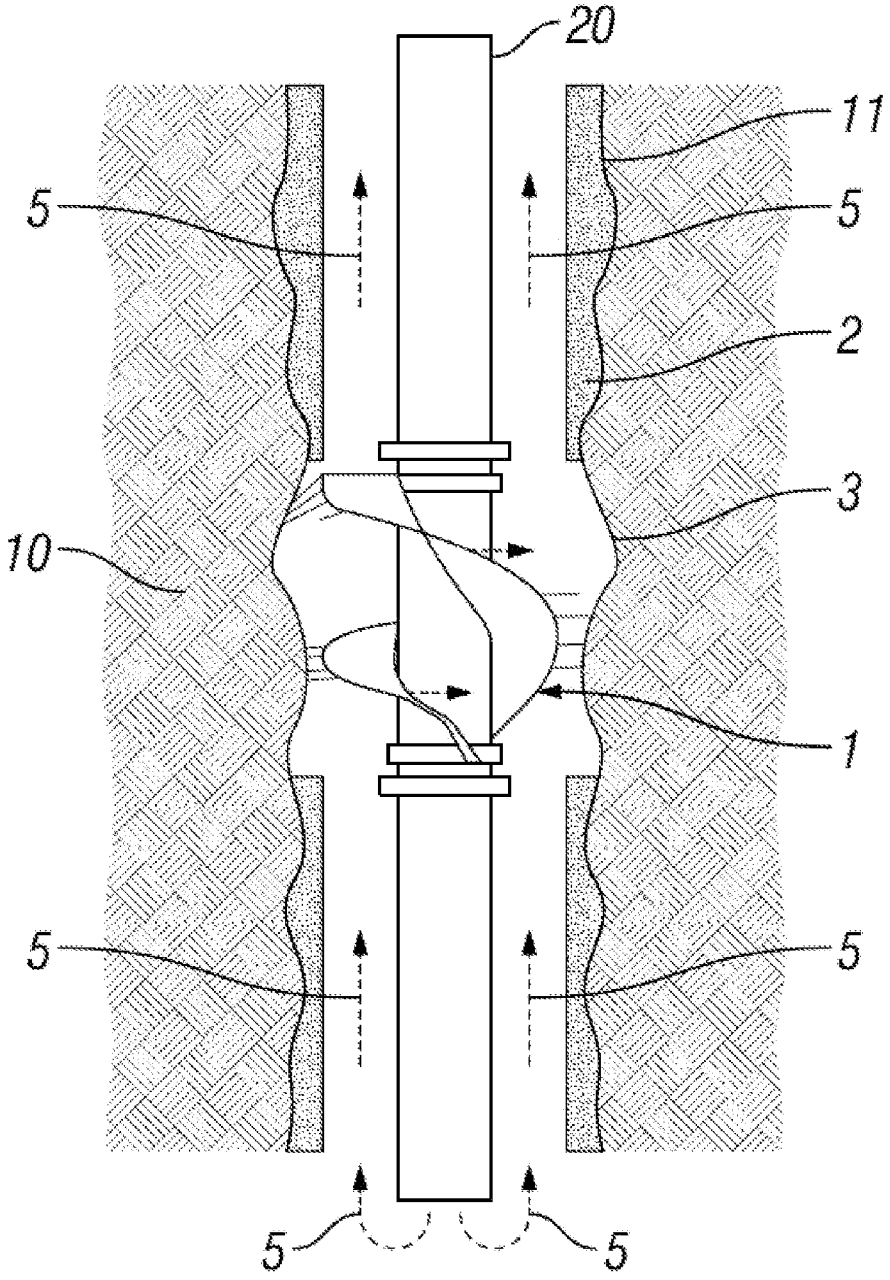
FIG. 1 shows a schematic diagram illustrating the apparatus according to the invention in a first embodiment within the wellbore.
Figure 2:
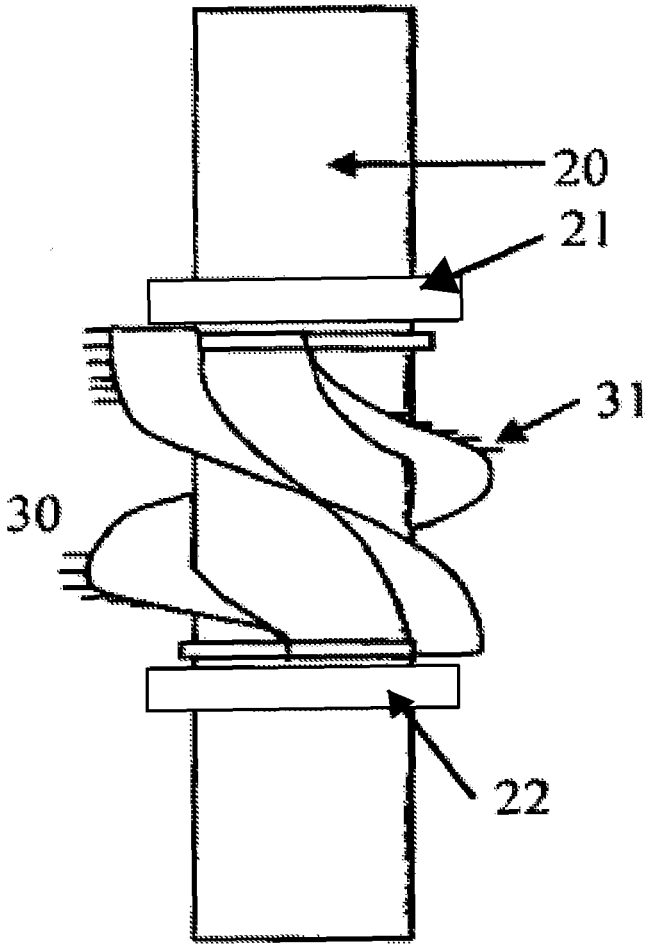
FIG. 2 shows a schematic diagram illustrating the apparatus according to the invention in a first embodiment.

FIG. 1 shows the wellbore cleaning device in a well, comprising a formation 10, a wellbore wall 11 and the rotating scratcher 1 inside. The rotating scratcher comprises at least one helical blade 30 equipped with flexible wires 31 that are long enough to touch the wellbore wall. A fluid 5 circulates in the annulus between a tubular 20 and the wellbore wall. A deposit 2 is situated on the wellbore wall. The action of the rotating scratcher 1 removes the deposit 2, leaving a cleaned wellbore wall 3. In a first embodiment, the well bore cleaning device is able to rotate radially only. FIG. 2 shows the cleaning device in more detail. The cleaning device is made of one of several helical blades 30, fastened together. These blades can freely rotate around the casing and their axial movement is restricted by means of top and bottom stop collars 21 and 22 fastened to a tubular 20. The blades are equipped with flexible wires 31 long enough to touch the wellbore wall 11. These blades can be fitted with wires along their full length or only along part of their length to reduce the drag with the wellbore wall.

The flow of fluid 5 circulating axially in the wellbore imparts a rotating movement to the blades that, upon rotation, scratches any fragile deposit on the wellbore wall along the full length of the rotating scratcher. This fragile deposit may be made of filter cake, settled solids (barite or cuttings) or other kind of debris. The removed material is cleaned out of the hole by the flow of the annular fluid and leaves a cleaned wellbore wall 3.

The deposit 2 is this fully replaced by the circulating fluid. If the circulating fluid is a cement slurry, it will bond with the formation upon setting and provide an efficient hydraulic isolation barrier in the annulus. The hydraulic isolation in regions with a cleaned wellbore wall 3 will be much better than in untreated places without scratchers because the presence of a fragile deposit at the cement-formation interface presents an easy leakage path.

Figure 3:
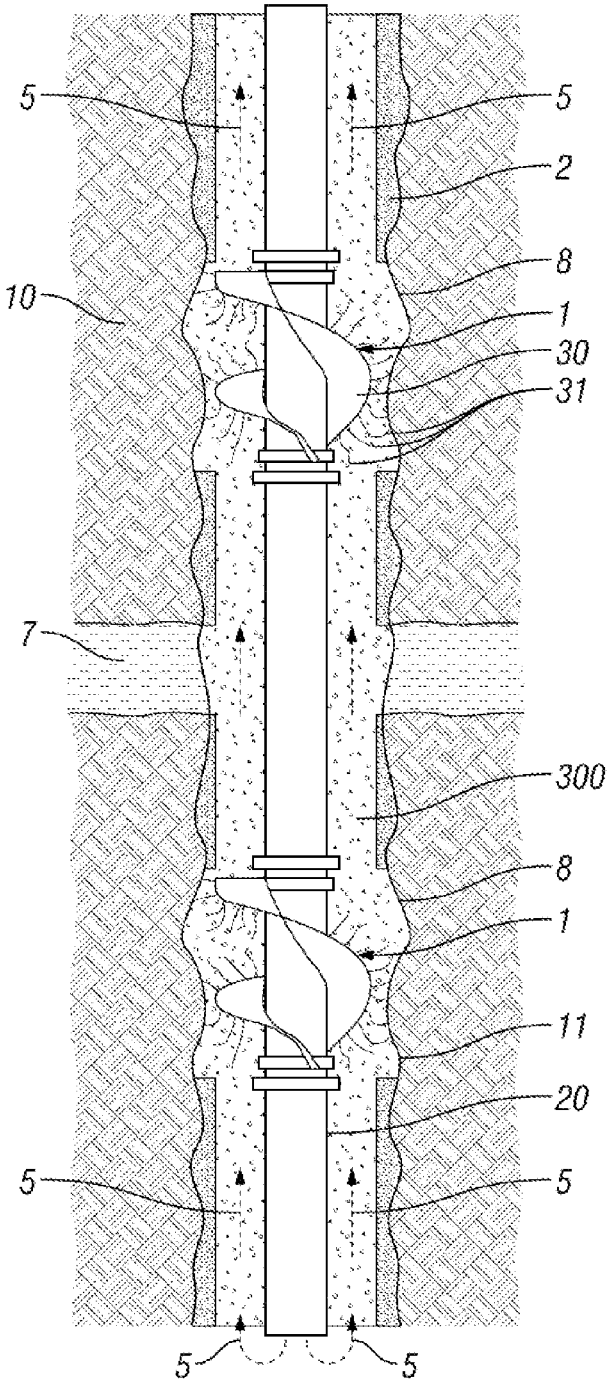
FIG. 3 shows a schematic diagram illustrating the apparatus according to the invention in a second embodiment within the wellbore.
Figure 4:
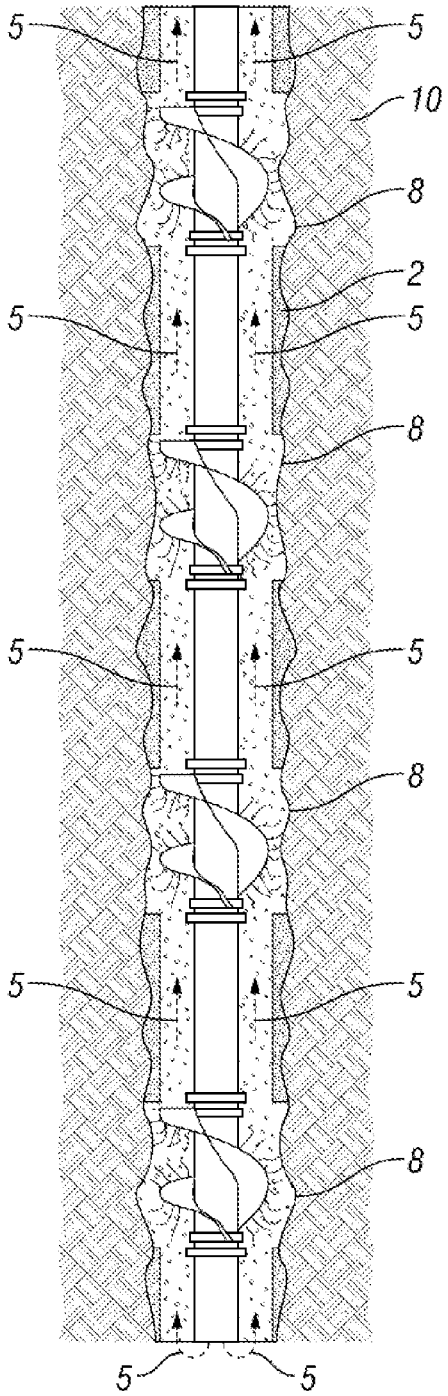
FIG. 4 shows an alternate schematic diagram illustrating the apparatus according to the invention in a second embodiment within the wellbore.

In a second embodiment, the wellbore cleaning device is equipped with a plurality of rotating scratchers on the tubular, placed at different depths along the tubular to ensure several hydraulic isolation sections along the well (FIG. 3). Rotating cleaning devices can be placed above and below a zone of interest 7, in order to insure hydraulic isolation from other zones above and below the reservoir. In such a way, cement 300 in direct contact with the wellbore wall 11 provides a section with an efficient hydraulic seal 8. Similarly, multiple rotating cleaning devices can be used in long sections in order to provide several hydraulic seal sections at any required casing or pipe (i.e., surface casing, intermediate casing, etc), as illustrated in FIG. 4. In such a way also, cement in direct contact with the wellbore wall provides a section with an efficient hydraulic seal 8.

Figure 5:
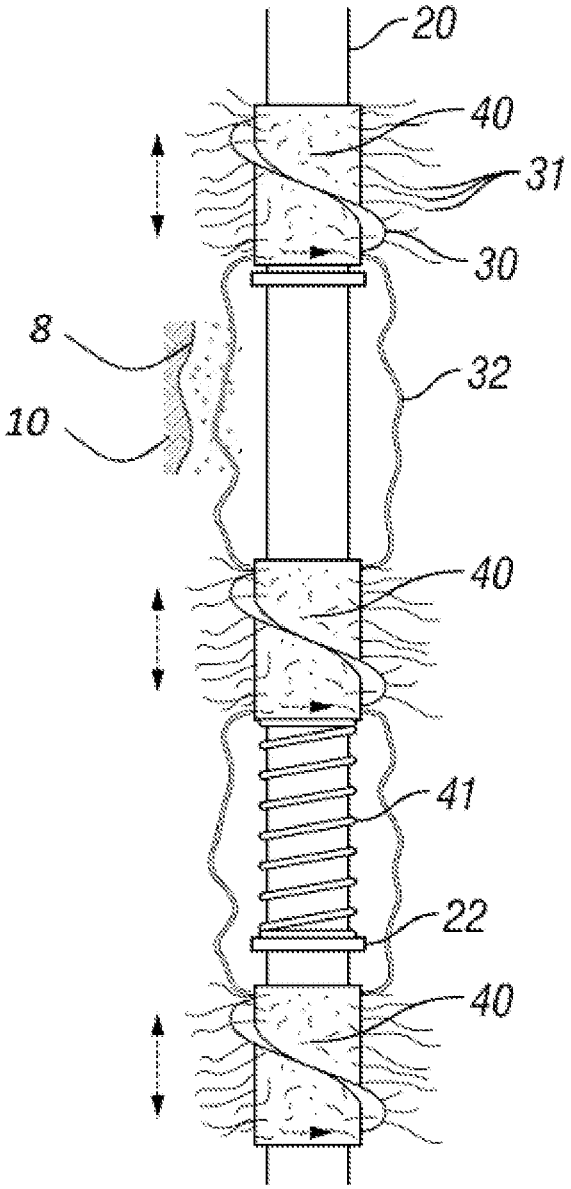
FIG. 5 shows a schematic diagram illustrating the apparatus according to the invention in a third embodiment within the wellbore.

In a third embodiment, the wellbore cleaning device is able to rotate radially and also move axially. FIG. 5 illustrates an example of a rotating and reciprocating cleaning device. The cleaning device is made of multiple "rings" 40 attached together. These rings can freely rotate around the casing and their axial movement is allowed within certain pre-determined length. The rings are equipped with flexible wires 31 long enough to touch the wellbore wall. These rings can be fitted with wires either along their full length or only along part of their length to reduce the drag with the wellbore wall. The rings are also fitted with helical blades 30 designed to make the rings rotate with the fluid circulating axially in the wellbore. In order to improve the cleaning efficiency, cleaning wires 32 can be used as link between two rings. These flexible wires would allow the rings to move axially within a certain length. Moreover, and whenever required, an axial movement restoring aid 41 (i.e., a spring, etc) attached to the stop collar 22, may be used to aid the movement against the flow (i.e., down towards the bottom of the casing). Axial movement of the rings would depend on fluids. properties and circulating rate. Therefore, depending on the drag force of the fluid applied on the ring, its axial position can change. In other words, changes of fluid type (washes, mud, cement, etc), and rates will lead to changes in the rings' axial position, extending the cleaning effect to a section effectively longer than the length of the ring.

As for the rotating cleaning device described before, the flow of the fluid circulating axially in the wellbore imparts a rotating movement to the rings which, upon rotation, will scratch any fragile deposit on the wellbore wall along the full length of the rotating scratcher. This fragile deposit may be made of filter cake, settled solids (barite or cuttings) or other kind of debris. The removed material is cleaned out of the hole by the flow of the annular fluid.

The deposit is thus fully replaced by the circulating fluid. If this circulating fluid is a cement slurry, it will bond with the formation upon setting and provide an efficient hydraulic isolation barrier in the annulus. This hydraulic isolation will be much better than in places without scratchers because the presence of a fragile deposit at the cement-formation interface presents an easy leakage path.

Preferably, the tubular will be equipped with a plurality of rotating and reciprocating scratchers, placed at different depths along the tubular to ensure several hydraulic isolation sections along the well.

Figure 6:
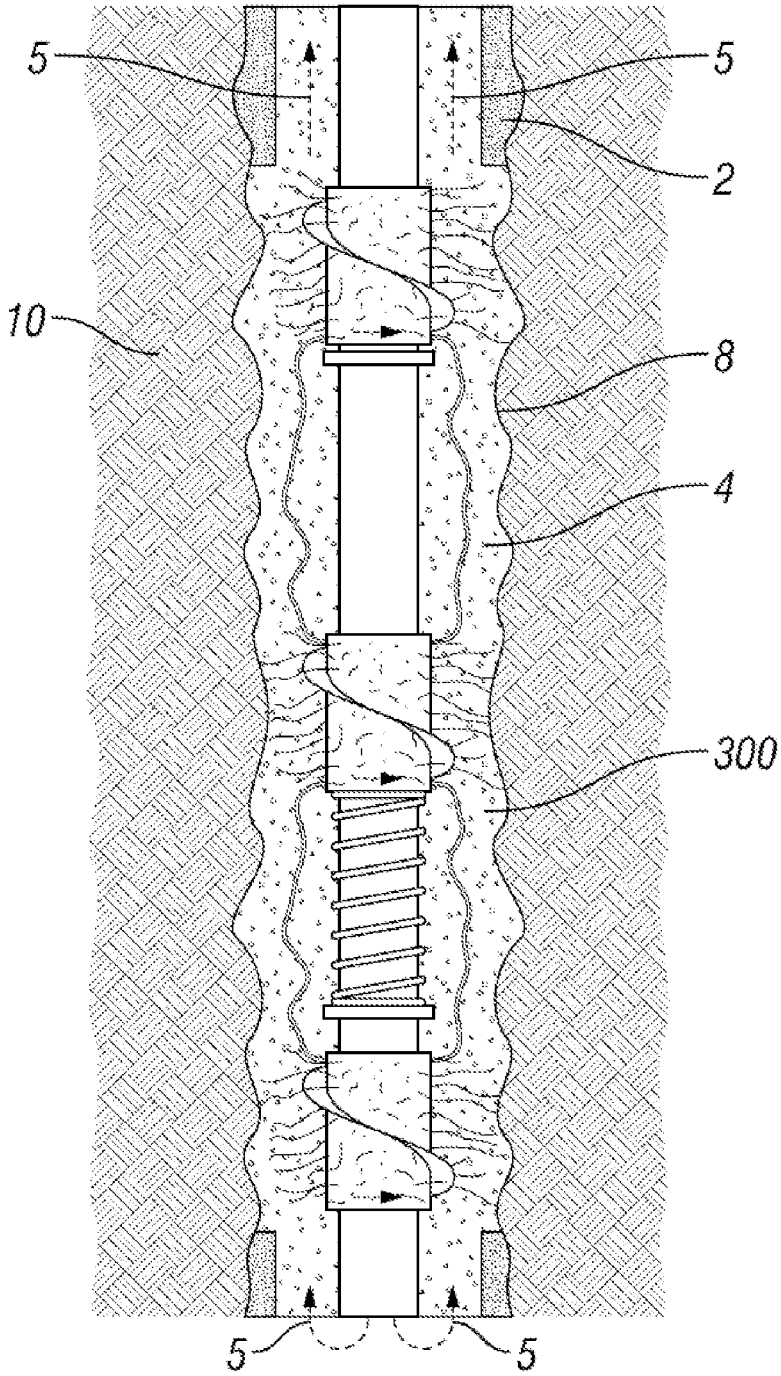
FIG. 6 shows an alternate schematic diagram illustrating the apparatus according to the invention in a third embodiment within the wellbore.

FIG. 6 illustrates the wellbore after cementing, where a rotating and reciprocating wellbore cleaning device was used before and during cement placement 300. In such a way, cement in direct contact with the wellbore wall provides a section with an efficient hydraulic seal 8.

Figure 7A:
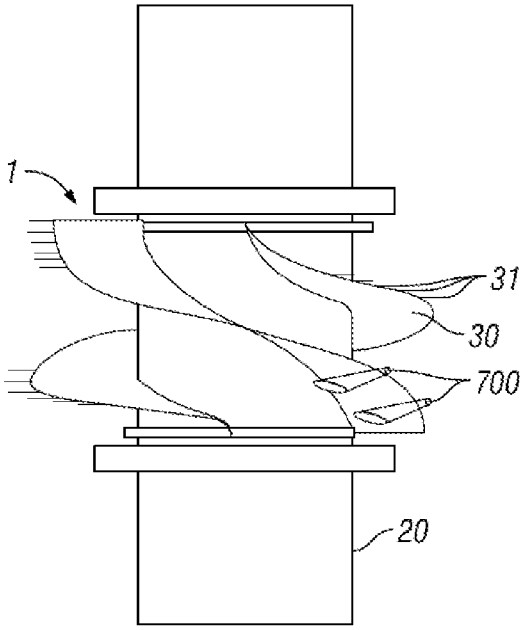
FIG. 7A shows a schematic diagram illustrating the apparatus according to the invention in a fourth embodiment.
Figure 7B:
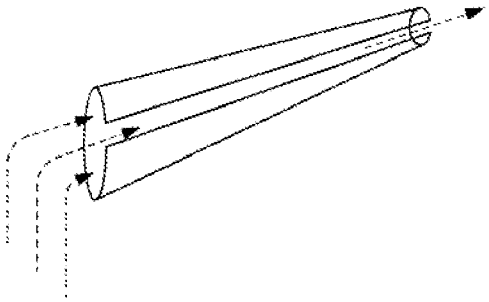
FIGS. 7B and 7C show two possible configurations of cones attached to the helical blades.
Figure 7C:
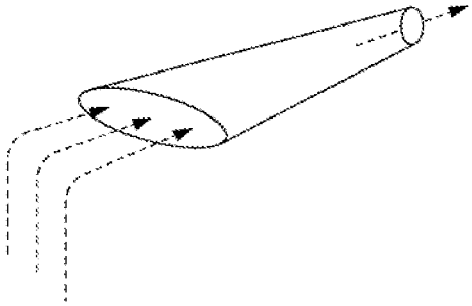

In a fourth embodiment, the wellbore cleaning device comprises one or more cones 700 in the wings or helicoidal part of the cleaning device to allow the circulating fluid to enter a cone and create a jet that can further clean (FIG. 7A). The shape of the cone can vary, as shown in FIGS. 7B and 7C.

The invention claimed is:

1. A device for cleaning a wellbore in a subterranean well, the wellbore having a wall, comprising: a tubular section having a bottom, at least two helical scratchers mounted thereon wherein said helical scratchers contain at least one helical blade fitted with flexible wires that are sufficiently long to touch the wellbore wall, characterized in that the helical scratchers are able to rotate axially to tubular section when a fluid flows axially to tubular section, and wherein the scratcher rotation is independent of tubular section movements, wherein the fluid flows out of the bottom of the tubular;

wherein the two helical scratchers are connected through a cleaning wire;

wherein the device further comprises a restoring aid connected on one side to the tubular section and on the other side on one of the helical scratchers; and wherein the restoring aid exerts force in a direction parallel to the tubular section.

2. The device of claim 1, comprising further on the helical scratcher a cone to create a jet with the fluid, wherein fluid enters the cone from an annular region between the tubular section and the wellbore wall.

3. A method to clean a wellbore wall of a well, comprising:

incorporating a device into the wellbore, said device comprising: a tubular section having a bottom, at least two helical scratchers mounted thereon wherein said helical scratchers contain at least one helical blade fitted with flexible wires that are sufficiently long to touch the wellbore wall, characterized in that the helical scratchers are able to rotate axially to the tubular section when a fluid flows axially to the tubular section;

allowing the fluid to flow out of the bottom of the tubular body and axially to the wellbore wall to rotate the scratcher;

removing the deposit at wellbore wall;

leaving a cleaned wellbore wall;

wherein the cleaning is independent of tubular section movements;

wherein the two helical scratchers are connected through a cleaning wire;

wherein the device further comprises a restoring aid connected on side to the tubular section and on the other side on one of the helical scratchers; and wherein the restoring aid exerts force in a direction parallel to the tubular section.

4. The method of claim 3, further comprising the step of selecting a zone of interest and using one scratcher above the zone of interest and a second scratcher below the zone of interest.

5. The method of claim 3, wherein the devices further comprises, on the helical scratcher, a cone to create a jet with the fluid, wherein fluid enters the cone from an annular region between the tubular section and the wellbore wall.

6. The method of claim 3, wherein the well is a highly inclined or horizontal well.

7. The method of claim 3 wherein the deposits are carried to surface by fluid flow, resulting in a cleaned wellbore.

8. The method of claim 7, wherein the fluid is a cement slurry.

9. The method of claim 4, wherein the zone of interest is a reservoir zone.

10. The device of claim 1, wherein the helical scratchers are made of several blades.

11. The device of claim 1, wherein the helical scratchers are made of multiple rings equipped with flexible wires.

12. The device according to claim 11, wherein the rings are able to freely rotate around the tubular section.

13. The device according to claim 1, wherein the tubular is equipped with a plurality of blades and rings.

14. A device for cleaning a wellbore having a wall comprising: a tubular section having a bottom, at least two helical scratchers mounted thereon wherein said helical scratchers contain at least one helical blade fitted with flexible wires that are sufficiently long to touch the wellbore wall, and are able to rotate axially to tubular section when a fluid flows from the bottom of the tubular section and axially along the tubular section wherein the two helical scratchers are connected through a cleaning wire and further comprising a restoring aid connected on one side to the tubular section and on the other side on one of the helical scratchers, wherein the restoring aid exerts force in a direction parallel to the tubular section, wherein the scratcher rotation is independent of tubular section movements.

15. The device according to claim 14, wherein the helical scratchers are made of multiple rings equipped with flexible wires.

16. The device according to claim 14, wherein the tubular is equipped with a plurality of blades and rings.

* * * * *